US005136212A

United States Patent [19]

Eguchi et al.

[11] Patent Number: 5,136,212

[45] Date of Patent: Aug. 4, 1992

[54] ELECTRON EMITTING DEVICE, ELECTRON GENERATOR EMPLOYING SAID ELECTRON EMITTING DEVICE, AND METHOD FOR DRIVING SAID GENERATOR

[75] Inventors: Ken Eguchi; Haruki Kawada, both of Yokohama; Kunihiro Sakai; Hiroshi Matsuda, both of Isehara; Kiyoshi Takimoto, Kawasaki; Hisaaki Kawade, Atsugi; Yuko Morikawa, Kawasaki; Yoshihiro Yanagisawa, Atsugi, all of Japan

[73] Assignee: Canon Kabushiki Kaisha, Tokyo, Japan

[21] Appl. No.: 804,517

[22] Filed: Dec. 10, 1991

Related U.S. Application Data

[63] Continuation of Ser. No. 593,486, Oct. 3, 1990, abandoned, which is a continuation-in-part of Ser. No. 310,615, Feb. 15, 1989, abandoned.

[30] Foreign Application Priority Data

Feb. 18, 1988 [JP] Japan ..... 63-033934
Feb. 18, 1988 [JP] Japan ..... 63-033936

[51] Int. Cl.[5] ..... H01J 1/30

[52] U.S. Cl. ..... 315/150; 315/155; 313/346 R

[58] Field of Search ..... 315/150, 155; 357/30, 357/31; 358/209, 213.11; 250/213 VT; 313/346 R

[56] References Cited

U.S. PATENT DOCUMENTS 3,407,394 10/1968 Hartke ..... 315/150
3,735,186 5/1973 Klopfer et al. ..... 313/346 R
3,921,031 11/1975 Dubois et al. ..... 315/94
4,005,465 1/1977 Miller ..... 357/6

FOREIGN PATENT DOCUMENTS 0041119 12/1981 European Pat. Off. .

*Primary Examiner*—David Mis
*Attorney, Agent, or Firm*—Fitzpatrick, Cella, Harper & Scinto

[57] ABSTRACT

An electron emitting device, comprising: a first electrode provided on a substrate; a first layer provided on said electrode and capable of undergoing transition from an electrically high resistance state to a low resistance state when irradiated by a radiant ray; and a conductive layer, an insulating layer and a second electrode, laminated on said first layer. An electron generator includes the electron emitting device as well as an applicator for applying an electric field to said device, and an irradiator for irradiating a radiant ray on the device. A method for driving the electron emitting device is also provided.

41 Claims, 5 Drawing Sheets

ELECTRON EMITTING DEVICE, ELECTRON GENERATOR EMPLOYING SAID ELECTRON EMITTING DEVICE, AND METHOD FOR DRIVING SAID GENERATOR

This application is a continuation of application Ser. No. 07/593,486 filed Oct. 3, 1990, now abandoned, which is a continuation-in-part of application Ser. No. 07/310,615 filed Feb. 15, 1989, now abandoned.

BACKGROUND OF THE INVENTION

1. Field of the Invention

The present invention relates to an electron emitting device, and particularly to an electron emitting device used in an electron generator (or electron-generating apparatus). It is also concerned with a method for driving said electron emitting device or electron generator.

2. Related Background Art

Known as solid-state electron beam generators are apparatus in which an electric field is applied to a junction between dissimilar materials, formed in a semiconductor, to cause electron beams to be radiated outside from the surface of the semiconductor.

For example, Japanese Patent Publication No. 54-30274 discloses an apparatus in which a forward voltage is applied to an np junction formed in a mixed crystal of AlP with GaP to cause electrons to be emitted from the surface of a P-type region. Japanese Patent Laid-Open No. 54-111272 discloses a solid-state electron beam generator in which a reverse voltage is applied to a pn junction at least a part of which has been exposed into an opening provided in an insulating layer on the surface of a semiconductor, and also an accelerating electrode is so provided to the insulating layer as to extend to the edge of the opening. Japanese Patent Laid-Open No. 56-15529 also discloses a semiconductor device in which an accelerating electrode is provided at the edge of an opening provided in an insulating layer on the surface of a semiconductor, and a reverse voltage is applied to a pn junction extending, within the opening, in parallel to the surface of the semiconductor to cause electrons to be emitted outside the semiconductor. These Japanese Patent Laid-Open Nos. 54-111272 and 56-15529 each also disclose an electron beam generator comprising electron-emitting devices integrated on a semiconductor substrate, respectively. Also, Japanese Patent Laid-Open No. 57-38528 discloses an electron-emitting multiple cold cathode in which devices capable of emitting electrons from the surface of a semiconductor by applying a bias voltage to a pn junction in the forward direction are integrated on a semiconductor substrate.

These solid-state electron beam generators have a number of advantages such that they are compact and capable of emitting electrons by use of the voltage applied to the pn junction. Making the most of the advantage that they can be made compact, it can be contemplated to provide an apparatus in which a plurality of electron beams are arranged, but the wiring for driving such an electron beam generator becomes complicated, thereby raising another problem.

On the other hand, D. J. Barteling, J. L. Moll and N. I. Meyer report in Phys. Rev. Vol. 130, Number 3 (1963) 972–985 that in instances in which a reverse voltage is applied to cause electron avalenches to generate electrons, it is also possible to irradiate light on the P-type region to excite electrons, thereby driving the generator. Since, however, the light used to excite electrons is incident from the electron beam emission side, this has imposed a great limitation on the manufacture of apparatus that utilize electron beams.

SUMMARY OF THE INVENTION

An object of the present invention is to provide an electron emitting device, comprising a first layer capable of undergoing transition from an electrically high resistance state to a low resistance state when irradiated by a radiant ray and a second layer capable of emitting electron, laminated on a substrate, which can eliminate the above disadvantages involved in the prior art, and is capable of emitting an electron beam according to an input of light and with a simple constitution, and also to provide an electron emitting device that can use light in a wide wavelength range as an input signal.

Another object of the present invention is to provide an electron emitting device, comprising;

a first electrode provided on a substrate;

a first layer provided on said electrode and capable of undergoing transition from an electrically high resistance state to a low resistance state when irradiated by a radiant ray; and a conductive layer, an insulating layer and further a second electrode, laminated on said first layer, which can effectively achieve driving of electron emitting devices without any complicated wiring, when a plurality of the electron emitting devices are arranged in a matrix fashion to form a solid-state electron beam generator.

Another object of the present invention is to provide an electron generator, comprising said electron emitting device, a means for apoplying an electric field to said device, and a means for irradiating a radiant ray on said device.

Further another object of the present invention is to provide a method for driving an electron emitting device, comprising;

applying a voltage to an electron emitting device comprising a first electrode provided on a substrate; a first layer provided on said electrode and capable of undergoing transition from an electrically high resistance state to a low resistance state when irradiated by a radiant ray; and a conductive layer, an insulating layer and further a second electrode, laminated on said first layer; the voltage being kept applied between said first electrode and said second electrode; and making light incident from the first electrode side to generate an electron beam from the electrode surface on the side opposite to the light-incident side.

Now, to achieve the above objects, the present invention provides an electron emitting device, comprising lamination of;

a first electrode provided on a substrate;

a photoswitching layer provided on said electrode and capable of undergoing transition from an electrically high resistance state to a low resistance state when irradiated by a radiant ray; and an electron-emitting layer formed on said switching layer and comprising a conductive layer, an insulating thin film and further a second electrode.

DETAILED DESCRIPTION OF THE PREFERRED EMBODIMENTS

The electron emitting device of the present invention, which is driven by light, is characterized by having an electron-emitting portion comprising an insulating thin film disposed between a pair of electrodes, and further a photoswitching portion capable of undergoing transition from an electrically high resistance state to a low resistance state when irradiated by light, which is connected in series with said electron-emitting portion.

More specifically, in the device of the present invention, the above switching portion undergoes transition from an electrically high resistance state to a low resistance state when irradiated by light, and a high electric field exceeding a threshold value is applied to the electron-emitting portion of an MIM type, thereby generating an electron beam. In short, irradiation by light can readily achieve emission of electron beams.

It is further possible to impart a memory function to the above switching performance, and it is still further possible to use a wide range of wavelengths as the light used for input signals.

Preferred embodiments of the present invention will be described below.

Figure 1:
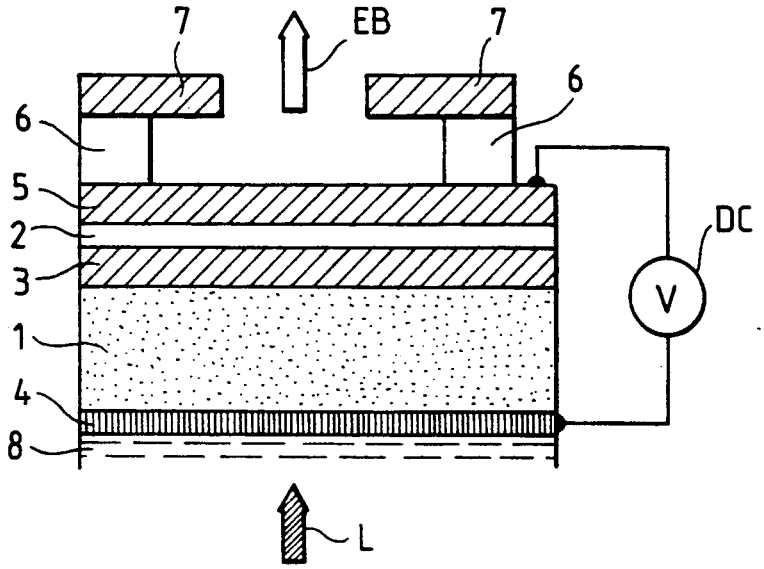
FIGS. 1 and 2 are each a cross section of the electron emitting device of the present invention.

FIG. 1 is a view to cross-sectionally illustrate the electron emitting device the present invention aims for. In FIG. 1, the numeral 1 denotes a semiconductor layer that shows a photoswitching performance, and there can be used, for example, a thin film made of amorphous silicon (a-Si), CdSe, CdS or ZnS, which exhibit photoconductivity. The numeral 2 denotes an insulating thin film; and 3, a conductive layer. The numeral 4 denotes a first electrode, which may preferably comprise a transparent electrode made of $SnO_2$ or ITO, but it is also possible to use a metal electrode comprising a metal such as Al, Au or Pt deposited in a semi-transparent state. The numeral 5 denotes a second electrode; 6, an insulating layer comprising, for example, $SnO_2$; and 7, an electron-accelerating electrode.

The principle of how the device of the present invention operates will be described below. In the present device, a forward bias is applied between the first and second electrodes, i.e., the upper and lower electrodes, through a drive circuit DC. This applied voltage is set to a level slightly higher than the threshold voltage at which electrons begin to be emitted from the MIM structure (constituted of 3/2/5). As illustrated in FIG. 1, the light L incident from the substrate 8 side is transmitted through the first electrode 4 and switches the semiconductor layer 1 into a low resistance state. As a result, the electric field applied to the device turns to be applied entirely to the MIM structure, where the electrons having passed through the insulating thin film 2 by tunneling go through the second electrode 5, and are further accelerated by the electric field produced by the accelerating electrode 7, so that an electron beam EB is emitted.

Since, however, the length over which electrons can pass through a potential barrier of the solid-state electron beam generator by tunneling is so small that the insulating thin film should comprise an ultra-thin film, more specifically, have a film thickness in the range of from several angstroms to several hundred angstroms, preferably not more than 200 Å, and more preferably not more than 100 Å and not less than 5 Å. It should be further noted that the device performance and the stability thereof are greatly affected by whether or not such an insulating thin film is homogeneous in its in-plane and thickness directions.

In a preferred embodiment of the present invention, a method most suited for forming the insulating thin film may include the LB process.

This LB process can readily form a monomolecular film of an organic compound, having the hydrophobic part and hydrophilic part in one molecule, or a built-up film thereof, on any electrode or on any substrate containing any electrode, and also can stably provide an organic ultra-thin film in the order of a molecular length, which is uniform and homogeneous over a large area.

The LB process is a process of making a monomolecular film or a built-up film thereof by utilizing the mechanism that when a hydrophilic part and a hydrophobic part are appropriately balanced (i,e, amphipatic balance) in a structure having the both parts in the molecule, the molecule forms a monomolecular layer on a water surface with its hydrophilic group downward.

The group that constitutes the hydrophobic part includes all sorts of hydrophobic groups such as saturated or unsaturated hydrocarbon groups and condensed polycyclic aromatic groups, which are commonly well known in the art. These groups constitute the hydrophobic part alone or in combination of plural ones. On the other hand, the group most typical as a component for the hydrophilic part may include hydrophilic groups as exemplified by a carboxyl group, an ester group, an acid amido group, an imido group, a hydroxyl group, a sulfonyl group, a phosphoric acid group, and amino groups (primary, secondary, tertiary, and quaternary).

Molecules having these hydrophobic part and hydrophilic part in a good balance can form the monomolecular film on a water surface. In general, these molecules form an insulating monomolecular film, and hence the monomolecular built-up film also exhibits insulating properties, so that they can be said to be materials very preferable for the present invention. The following molecules can be exemplified.

(1) Molecules Having a $\pi$-Electron Level

Coloring matters having a porphyrin structure, such as phthalocyanine and tetraphenylporphyrin; azulene dyes having a squarilium group and a croconic methine group as bonding chains; and dyes analogous to cyanine dyes, combined through a squalilium group and a croconic methine group; or cyanine dyes; nitrogen-containing heterocyclic ring compounds such as quinoline, benzothiazole and benzoxazole; and chain compounds bonded with condensed polycyclic aromatics such as anthracene and pyrene and an aromatic ring or heterocyclic ring compounds; etc.

(2) Polymeric Compounds

Polyimide derivatives, polyamic acid derivatives, polyamide derivatives, all sorts of fumaric acid copolymers, all sorts of maleic acid copolymers, polyacrylic acid derivatives, all sorts of acrylic acid copolymers, polydiacetylene derivatives, all sorts of vinyl compounds, synthetic polypeptides, biopolymeric compounds such as bacteriorhodopsin and cytochrome C.

(3) Fatty Acids

Carboxylic acids and carboxylic acid salts, having a long-chain alkyl group, or fluorinated derivatives of these, esters having at least one long-chain alkyl group, sulfonic acid and salts thereof, phosphoric acid and salts thereof, or fluorinated derivatives of these.

Of these compounds, polymeric compounds, or macrocyclic compounds such as phthalocyanine are desirably used particularly from the viewpoint of thermal resistance. In particular, use of polymeric materials such as polyimides, polyacrylic acids, all sorts of fumaric acid copolymers or all sorts of maleic acid copolymers can not only bring about such a superior thermal resistance but also reduce the film thickness per layer to about 5 Å.

In the present invention, needless to say, any materials other than the above are also preferred in the present invention so long as they are suited to the LB process.

Such amphiphatic molecules form a layer of monomolecules on a water surface with their hydrophilic groups downward. In this occasion, the monomolecular layer on the water surface has the feature of a two-dimensional type, and, when the molecules are scatteredly spread out, an equation of two-dimensional ideal gas:

$$\pi A = kT$$

is established between the area A per molecule and the surface pressure $\pi$ to form "a gas film". Here, k is the Boltzmann's constant, and T, the absolute temperature. The mutual action between molecules can be strengthened by making A sufficiently small, to form "a condensed film (or solid film)" comprising a two-dimensional solid. The condensed films can be transferred layer by layer on the surfaces of any articles such as resins or metals having various quality and shapes. The monomolecular film or the built-up film thereof can be formed by using this method, and the resulting film can be used as an insulating zone, i.e., the potential barrier layer, for use in a photoswitching device exemplified by the present invention.

Figure 5:
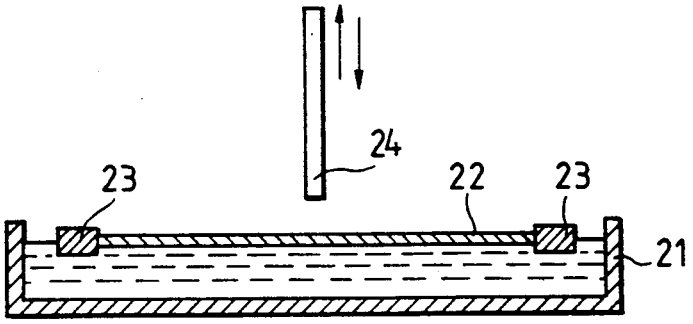
FIG. 5 is an explanatory view to illustrate a method of forming the insulating layer of the present invention according to an LB process.

A specific preparation method includes, for example, the following:

A desired organic compound is dissolved in a solvent such as chloroform, benzene or acetonitrile. Next, using a suitable apparatus as illustrated in FIG. 5 of the accompanying drawings, the resulting solution is spread over an aqueous phase 21 to form an organic compound film.

Figure 6A:
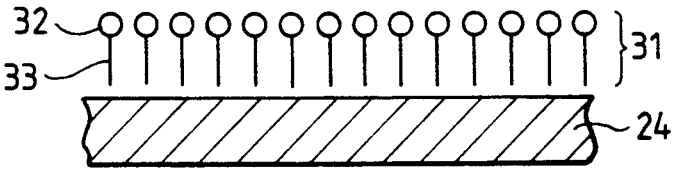
FIGS. 6A and 6B are diagramatical views of monomolecular films.

Next, a partition plate (or a float) 23 is provided so that the resulting spread film 22 may not be freely diffused and excessively spread on the aqueous phase 21, thereby limiting the spreading area of the spread film 22 and controlling the gathering state of film substances, to obtain the surface pressure $\pi$ proportional to the gathering state. This partition plate 23 is moved to reduce the spreading area to control the gathering state of the film substance, so that the surface pressure is gradually increased so as to be set to the surface pressure $\pi$ suited for the preparation of the film. While maintaining this surface pressure, a clean substrate 24 is gently vertically raised or lowered, so that the monomolecular film of the organic compound is transferred on the substrate 24. Such a monomolecular film 31 is a film in which the molecules are arranged with the neat order as diagramatically illustrated in FIG. 6A or FIG. 6B.

The monomolecular film 31 is prepared in the above way, and the above operation may be repeated to form the built-up film with a desired build-up number. The monomolecular film 31 can be transferred on the substrate 24 not only by the above-described vertical dip method but also by a horizontal adhesion method, a rotating cylinder method, etc.

The horizontal adhesion method is a method in which the substrate is horizontally brought into contact with the water surface to transfer the monomolecular film 31 on the substrate, and the rotary cylinder method is a method in which a cylindrical substrate is rotated on the water surface to transfer the monomolecular film 31 on the surface of the substrate.

Figure 6B:
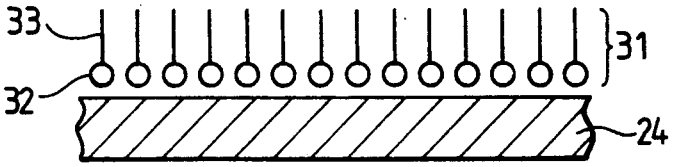
Figure 7A:
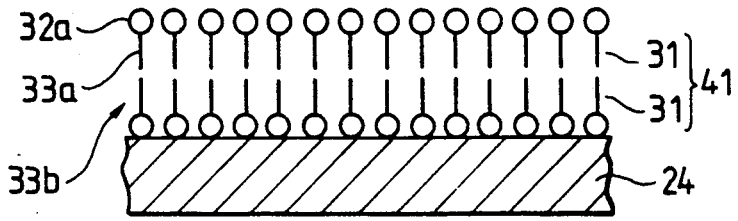
FIGS. 7A, 7B and 7C are diagramatical views of built-up films.
Figure 7B:
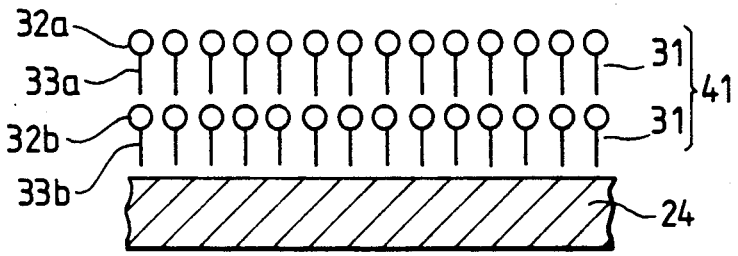
Figure 7C:
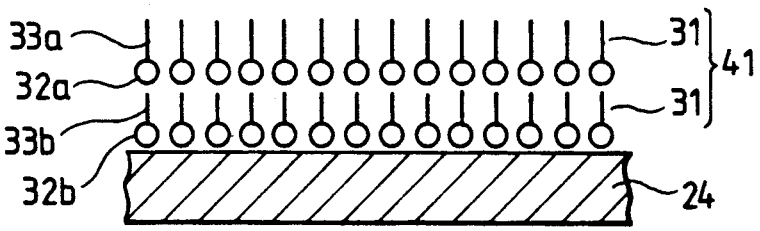

In the above vertical dip method, the substrate 24 having a hydrophilic surface is drawn up from the water in the direction crossing the water surface, so that the monomolecular film 31 of the organic compound whose hydrophilic part 32 faces the substrate 24 side is formed on the substrate 24 (FIG. 6B). The substrate 24 may be raised and lowered as described above, and thus the monomolecular film 31 is built up layer by layer for each procedure, forming a built-up film 41. Since the directions of the film-forming molecules are set reversely in a drawing up step and in a dipping step, this method can form a Y-type film in which the hydrophobic group parts 33*a* and 33*b* of the organic compound have faced each other between the respective layers of the monomolecular films 31 (FIG. 7A). On the other hand, according to the horizontal adhesion method, the monomolecular film 31 wherein the hydrophobic parts 33 of the organic compound have faced the substrate 24 side is formed on the substrate 24 (FIG. 7B). According to this method, there is no alternation of the direction of film-forming molecules when monomolecular films 31 are built-up, and can be formed an X-type film in which the hydrophobic parts 32*a* and 33*b* have faced the substrate side in all the layers (FIG. 7B). On the contrary, a built-up film 41 in which the hydrophilic parts 32*a* and 32*b* have faced the substrate 24 side in all the layers is called a Z-type film (FIG. 7C).

The method of transferring the monomolecular film 31 on the substrate 24 is by no means limited to the above, and, in instances where a substrate with a large area is used, a method can be employed such that the substrate is push forward from a roll into the aqueous phase. Also, the manners in which the hydrophilic part and hydrophobic part face to the substrate are described above as a principle, and can also be relied on surface treatment of the substrate.

In the manner as above, the potential barrier layer comprised of the monomolecular film 31, or the built-up film 41 thereof, of the organic compound is formed on the substrate 24.

Processes other than the LB process, as exemplified by vacuum deposition, molecular beam epitaxy and electrolytic polymerization, can also be applied so long as the thin and uniform film can be formed. Such a film may also be formed using inorganic materials without limitation to the organic ones.

On the other hand, the conductive materials and the electrode materials may also be any of those having a high conductivity, including, for example, metals such as Au, Pt, Ag, Pd, Al, In, Sn and Pb, or alloys of these as exemplified by $LaB_6$ and TiC, and also graphite or silicide, as well as a number of materials including conductive oxides such as ITO, these of which can be considered to be applied in the present invention. Care should, however, be taken here not to damage the LB layer when an electrode is formed on the LB film in making the MIM structure in the present invention. For this purpose, it should be avoided to use fabrication or treatment steps that require high temperatures (>100° C.).

In addition, to take out tunneling electrons outside the upper electrode, the electrode may preferably have a thickness of not more than 500 Å, and more preferably not more than 200 Å.

Using the materials as having described in the above, the device of the present invention can be fabricated according to conventionally known thin-film techniques.

Figure 2:
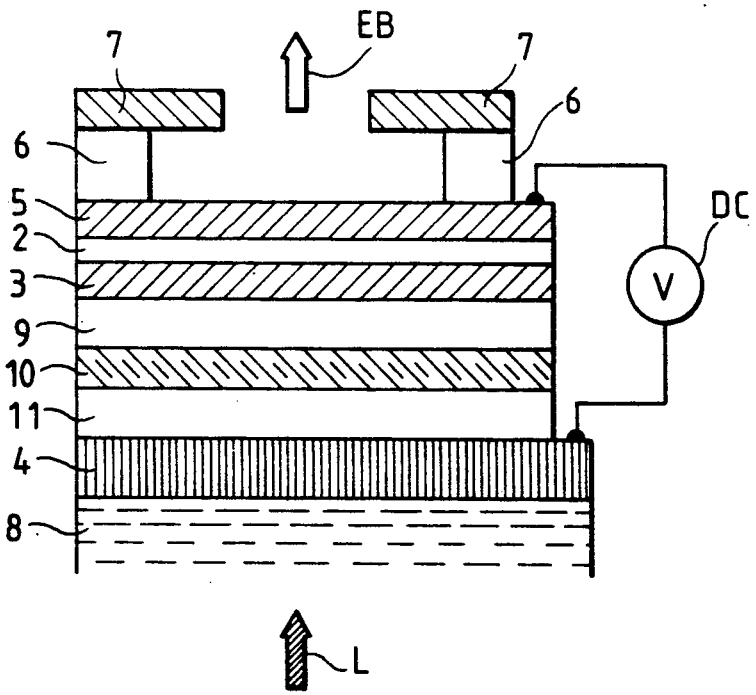

The electron emitting device may also be constituted as illustrated in FIG. 2. The device illustrated in FIG. 2 has a photoswitching portion provided with an alternatively laminated structure comprising an insulating thin film 9, a conductive thin film (or semiconductive thin film) 10 and another insulating thin film 11 which are disposed between a first electrode 4 and a conductive layer 3.

To describe more specifically, an insulating layer made of polyimide is formed on a substrate on which Au has been formed as the first electrode, i.e., the lower electrode, and then an Al layer is provided by vapor deposition, which Al layer is oxidized to form an $Al_2O_3$ layer, and finally Al is formed as the second electrode (upper electrode). On the device thus fabricated, light may be irradiated while applying an electric field between the both upper and lower electrodes, thus obtaining a device capable of switching an electric circuit from the switch-off state to the switch-on state when irradiated by light.

In this way, the photoswitching portion having the MIM structure may be connected in series with the above-described electron-emitting portion having the MIM structure (constituted of 3/2/5).

In this occasion, the second electrode made of Al in the photoswitching portion and the conductive layer 3 in the electron-emitting portion may be formed of the same layer as illustrated in FIG. 2.

The device illustrated in FIG. 2 is operated on the same principle as that of the device illustrated in FIG. 1. In the instance of this device, the on/off ratio at the photoswitching portion is as high as about $10^6$ and the current value in the on state can be set to a higher value, so that the current value of electron beams can also be made higher.

Figure 3:
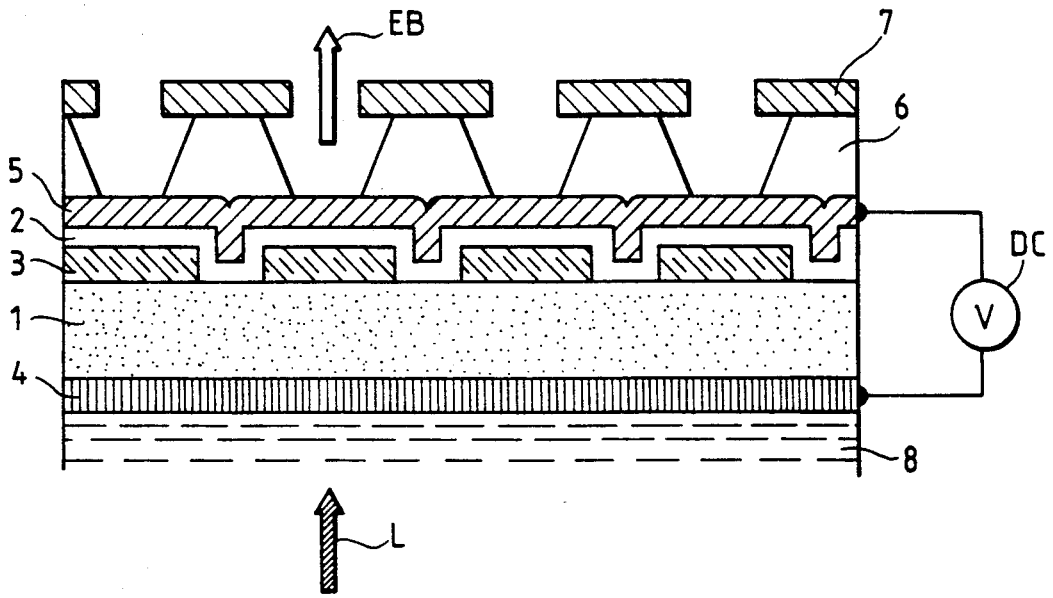
FIG. 3 is a cross section of an embodiment in which a plurality of the electron emitting device of the present invention are formed.

FIG. 3 illustrates a cross section of devices where the device of the present invention, as illustrated in FIG. 1, is formed in plurality. In FIG. 3, the conductive layer 3 formed is patterned corresponding to every picture element, i.e., every device for emitting electrons.

Figure 4:
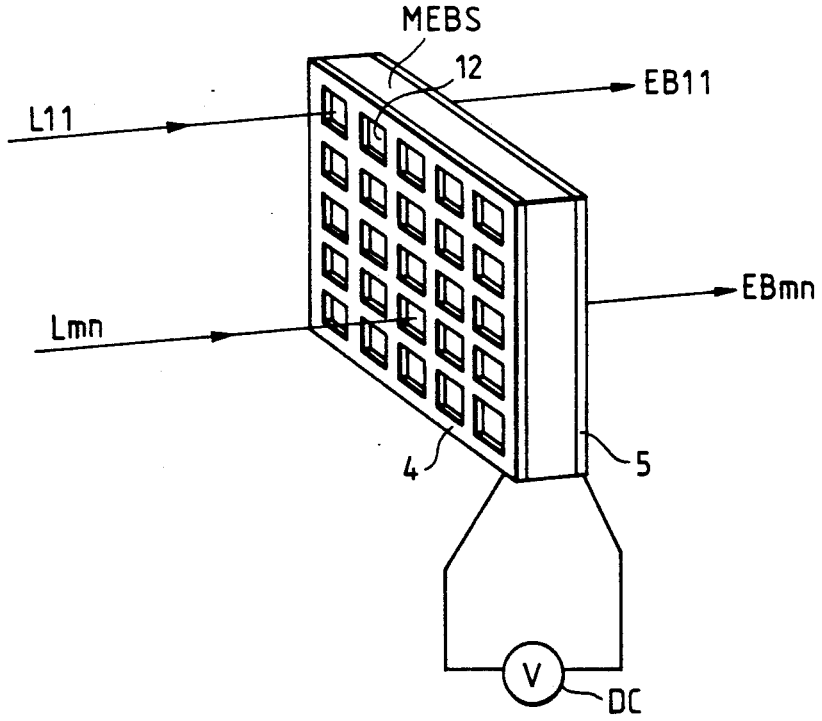
FIG. 4 is a partial view of the electron generator comprising the electron emitting devices of the present invention, arranged in a matrix fashion.

FIG. 4 illustrates an embodiment in which the electron emitting devices illustrated in FIG. 3 are arranged in a matrix fashion. A light source system may be further combined with this, thereby obtaining an effectively utilizable electron generator.

EXAMPLES

The present invention will be described below in greater detail by giving Examples.

Example 1

A device having the structure comprising the photoswitching layer 1, conductive layer 3, insulating thin film 2 and electrode 5 (FIG. 1) was fabricated in the following procedures: An amorphous silicon film with a film thickness of 1,000 Å was formed on a cleaned ITO glass-substrate (4+8) to form the photoswitching layer 1. In this occasion, the film was formed according to glow discharging (introduced gas: $SiH_4/H_2$; rf power: 0.05 W/cm$^2$; pressure: 0.12 torr; substrate temperature: 250° C.; deposition rate: 30 Å/min). Next, Al was vacuum deposited (film thickness: 600 Å) according to resistance heating to form the conductive layer 3. Thereafter, a ten-layers built-up film (film thickness: about 40 Å) of polyimide monomolecular films was formed by using the LB process, to provide the insulating thin film 2.

The process for making the polyimide monomolecule built-up film will be described below in detail.

The polyamide acid represented by formula (1) was dissolved in a mixed solvent of N,N'-dimethylacetamide with benzene (1:1 V/V) in concentration of $1\times10^{-3}$M calculated as the monomer, and thereafter the solution was mixed in 1:2 with a $1\times10^{3}$M solution separately prepared by dissolving N,N-dimethyloctadecylamine in the same mixed solution as above, thus preparing a solution of the polyamide acid octadecylamine salt represented by formula (2).

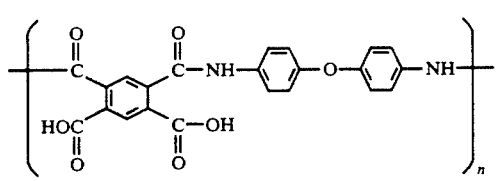
(1)

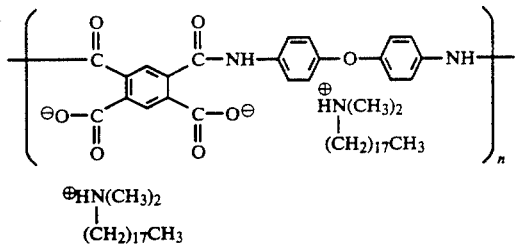
(2)

This solution was spread on the aqueous phase 21 (FIG. 5) comprised of pure water of 20° C. in water temperature to form a monomolecular film 31 on the water surface. After removal of the solvent by evaporation, a float as the partition plate 23 was moved to reduce the spreading area until the surface pressure was raised up to 25 mN/m. While keeping the surface pressure constantly, a substrate provided with the above lower electrode was gently put in water at a rate of 5 mm/min in the direction crossing the water surface, and thereafter subsequently gently drawn up at a rate of 3 mm/min, thus making a two-layers Y-type monomolecular built-up film. Such operations were repeated to form a ten-layers monomolecular built-up film of the polyimide acid octadecylamine salt. Next, such a substrate was immersed in a mixed solution of acetic anhydride, pyridine and benzene (1:1:3) for 12 hours to make the polyimide acid octadecylamine salt into an imide [Formula (3)] to obtain a ten-layers polyimide monomolecular built-up film.

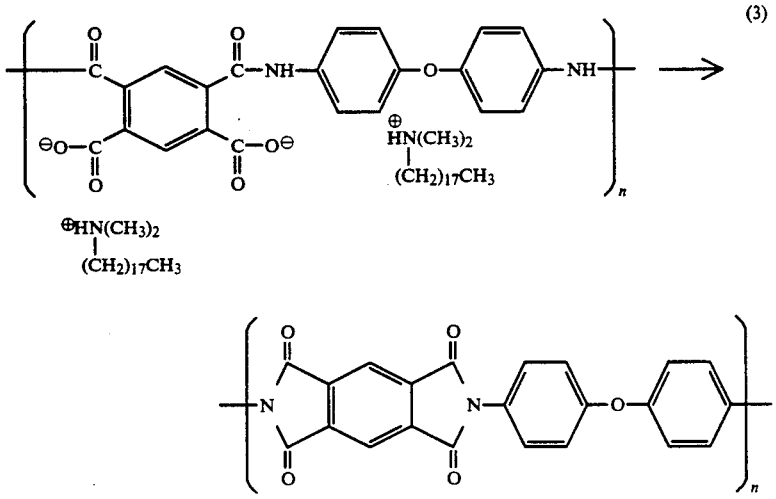

(3)

Next, on the surface of the above polyimide monomolecular built-up film, Au was vacuum deposited (film thickness: 300 Å) to form the electrode 5, and the accelerating electrode 7 was further additionally provided through an insulating layer 6, thus fabricating a electron emitting device (FIG. 1).

To the device fabricated in the above manner, a direct current voltage of 10 V was applied between the electrodes 4 and 5, setting the electrode 5 serving as the anode, and red light was irradiated from the ITO glass-substrate side. As a result, an electron beam emitting from the Au electrode 5 was confirmed.

Examples 2 to 5

Devices were fabricated in entirely the same manner as Example 1 except that the insulating thin film 2 was formed according to the LB process by use of the insulating materials shown in Table 1, and the electron beam conversion efficiency thereof was observed to obtain the results as shown in Table 1. A product by which a sufficient electron beam conversion efficiency was readily obtained was evaluated as AA; a product for which the applied voltage must be increased before obtaining a sufficient electron beam conversion efficiency, as B; and a product standing intermediate between them, as A.

TABLE 1

| Example | Material for insulating thin film 2 | Number of layer (thickness Å) | Film-forming conditions | Electron beam conversion efficiency |
|---|---|---|---|---|
| 2 | t-Butyl substituted lutetium diphthalocyanine | 6 (140) | F = 25 mN/m | AA |
| 3 | $C_{10}H_{21}C{\equiv}C{-}C{\equiv}C{-}(CH_2)_2COOH$ | 8 (140) | F = 25 mN/m; polymerized by ultraviolet light irradiation after film formation | B |
| 4 | SOAZ: 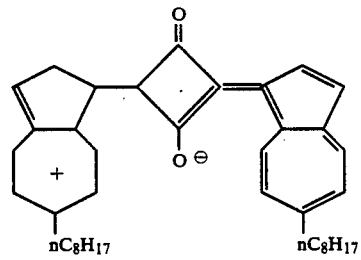 | 6 (90) | F = 20 mN/m | AA |
| 5 | 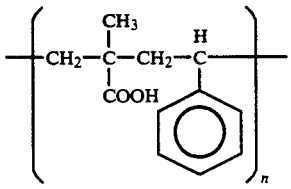 | 10 (50) | Film was formed by adding N-hexadecyldimethylamine (F = 25 mN/m), followed by removal thereof by immersion in n-hexane/acetic acid solution (50:1%) | A |

TABLE 1-continued

| Example | Material for insulating thin film 2 | Number of layer (thickness Å) | Film-forming conditions | Electron beam conversion efficiency |
|---|---|---|---|---|
| | Copolymer of methacrylic acid with styrene | | | |

Examples 6 to 10

Devices were fabricated in entirely the same manner as Example 1 except that the electrode 1 was formed according to vacuum deposition using an EB (electron beam) process by use of the insulating materials shown in Table 1, and the electron beam conversion efficiency thereof was observed. As shown in Table 2, electron beams were emitted with a sufficient electron beam conversion efficiency like that in Example 1.

TABLE 2

| Example | Material for electrode 1 | Film thickness (Å) | Substrate temperature in vapor deposition (°C.) | Electron beam conversion efficiency |
|---|---|---|---|---|
| 6 | Au | 100 | 200 | AA |
| 7 | Pt | 100 | 200 | AA |
| 8 | Pd | 100 | 200 | AA |
| 9 | W | 200 | 300 | A |
| 10 | CrNi | 200 | 300 | A |

Example 11

An electron emitting device was fabricated in entirely the same manner as Example 1 except that the photoswitching layer was formed with a CdS vapor-deposited film in place of the amorphous Si film.

Irradiation of white light resulted in emission of electron beams with a sufficient conversion efficiency.

Example 12

An electron emitting device was fabricated in entirely the same manner as Example 1 except that the insulating layer was prepared according to vapor deposition in place of the LB process.

Setting the gold electrode serving as the anode, a voltage of 10 V was applied to observe emission of an electron beam. The electron beam conversion efficiency was somewhat poorer than that of Example 1.

How to form the insulating layer by the vacuum deposition will be described.

Powder of polyphenylene sulfide (PPS) is put in a crucible, and evaporation is caused by heating with an indirectly heated heater. After sufficiently degassed accompanying the melting of PPS, the crucible temperature and substrate temperature were set to 400° C. and 200° C., respectively, to effect vapor deposition of PPS with a film thickness of 50 Å while monitoring a film thickness meter.

In the above-described Examples, the LB process has been used in forming the insulating layers, but any film formation processes can be used without limitation to the LB process, so long as they can make a very thin, uniform insulating thin film. They specifically include vacuum deposition, electrolytic polymerization, and CVD, thus expanding the range of usable materials. Needless to say, it is also possible to use oxide coatings of metal electrodes, having been hitherto studied for use in MIM-type electron-emitting devices.

Regarding also the formation of electrodes, any film formation processes may be used so long as they can make a uniform thin film, as having been described, to which the present invention requires no limitations. The present invention further requires no limitations to the materials for the substrate or the shape of the device.

Example 13

An electron emitting device was fabricated in entirely the same manner as Example 1 except that a pnpn-type photodiode substrate was used in place of the ITO glass-substrate and photoswitching film. The electron-emitting portion (constituted of 5, 2 and 3 in FIG. 1) was laminated on the anode side of the pnpn-type photodiode. Irradiation of white light resulted in emission of an electron beam, and also successive emission of the electron beam even after stop of irradiation of the white light, showing that a memory function was imparted. Moreover, it was possible to stop the electron beam from emission by lowering the voltage applied to the device.

Example 14

An electron emitting device was fabricated, having the structure as illustrated in FIG. 2, comprising a transparent or semitransparent electrode 4; a conductive layer 3; a photoswitching portion provided with an alternately laminated structure comprising an insulating thin film 9, a conductive thin film (or semiconductive thin film) 10, and another insulating thin film 11, which are disposed between said electrode 4 and conductive layer 3; and an electron-emitting portion comprising said conductive layer 3, an electrode 5, and an insulating thin film 2 disposed between said conductive layer 3 and electrode 5; which are laminated in series on a substrate 8.

A specific fabrication process will be described below.

On the glass substrate (8 in FIG. 2) having been subjected to hydrophobic treatment by leaving it overnight in saturated vapor of hexamethyldisilazane (HMDS), Cr was deposited with a thickness of 300 Å as a subbing layer according to vacuum deposition, and Au was further deposited (film thickness: 600 Å) by the same procedure, thus the semitransparent electrode 4 was formed. On such a substrate, a ten-layers built-up film (film thickness: 40 Å) of polyimide monomolecular film was formed by using the LB process, to provide the insulating thin film 11. The polyimide monomolecular built-up film was prepared in the same procedures as Example 1.

Next, on the surface of such a polyimide monomolecular built-up film, Al was vacuum deposited (film thickness: 20 Å) to form the conductive thin film 10. In this occasion, the temperature of the substrate surface was kept at room temperature or lower, and the film formation rate at this time was 3 Å/sec. Thereafter, the inside of the chamber was restored to normal pressure to oxidize the surface of such an Al conductive thin film, thus the insulating thin film 9 of $Al_2O_3$ was formed. Thereafter, the inside of the chamber was again evacuated to carry out vapor deposition of Al (film thickness: 600 Å), thus providing the conductive layer 3.

On the above Al conductive layer 3, a ten-layers built-up film of polyimide monomolecular films was further formed following the procedures in Example 1 by using the LB process, to provide the insulating thin film 2, followed by vacuum deposition of Au (film thickness: 300 Å) to provide the electrode 5. Next, an accelerating electrode 7 was additionally provided, thus an electron emitting device was fabricated.

To the sample fabricated in the above manner, a direct current voltage of 10 V was applied between the electrode 5 and semitransparent electrode 4, setting the electrode 5 serving as the anode, and white light was irradiated from the glass substrate side. As a result, an electron beam was confirmed to be emitted.

Example 15

On the glass substrate 8, Cr was deposited with a thickness of 300 Å as a subbing layer according to vacuum deposition, and Au was further deposited (film thickness: 600 Å) by the same procedure, thus forming the semitransparent electrode 4. On such a substrate 8, a ten-layers built-up film of polyimide monomolecular films was formed according to the same procedures as Example 1, to provide the insulating thin film 11.

Next, on the surface of such a polyimide monomolecular built-up film, an amorphous silicon film was formed with a film thickness of 30 Å to provide the semiconductive thin film 10. In this occasion, the film was formed according to glow discharging (introduced gas: $SiH_4$, $H_2$; rf power: 0.01 W/cm$^2$; pressure: 0.5 torr; substrate temperature: 250° C.; deposition rate: 40 Å/min). Subsequently a mixed gas of silane ($SiH_4$) gas with ammonia gas was introduced to make deposition of a silicon nitride ($Si_3N_4$) film with a film thickness of 15 Å (rf power: 0.02 W/cm$^2$; pressure: 0.5 torr; substrate temperature: 250° C.; deposition rate: 50 Å/min), thus the insulating thin film 9 was formed.

Next, on the surface of such a silicon nitride film, Al was vacuum deposited (film thickness: 600 Å) to provide the conductive layer 3. The insulating thin film 2 and electrode 5 were further formed according to the same procedures as Example 14. The electron-emitting characteristics of the resulting sample was measured in the same manner as Example 14 to find that it showed a similar electron emitting beam conversion performance.

Example 16

The following description will be made with reference to FIG. 4. The present Example provides an example in which the electron emitting device as illustrated in FIG. 3 is arranged in a matrix fashion (MEBS). Hitherto, in instances in which a plurality of electron emitting devices of this type are integrated and are each independently driven, the wiring to each device is necessarily complicated, and this has caused an obstruction to the achievement of a high integration. In the instance of the present device, a plurality of electron emitting devices MEBS are merely provided with a common first electrode 4 on the light input side, and on the other hand provided with a common second electrode 5 on the electron beam emission side, where openings 12 provided with a conductive layer having been patterned and serving as an intermediate electrode are provided corresponding respectively to electron beam sources. A voltage slightly larger than the voltage at which the emission of electrons occurs from the MIM structure portion constituted of the conductive layer and the second electrode is applied between the common first electrode 4 and common second electrode 5, and the emission of the respective electron beams are so designed as to take place when light is inputted to the substrate side corresponding to the electron beam sources. As illustrated in FIG. 4, the electron beam EB11 is emitted from the electron beam generating device into which the light L11 has entered, and similarly the electron beam EBmn, from the device into 1 which the light Lmn has entered.

Example 17

Figure 8:
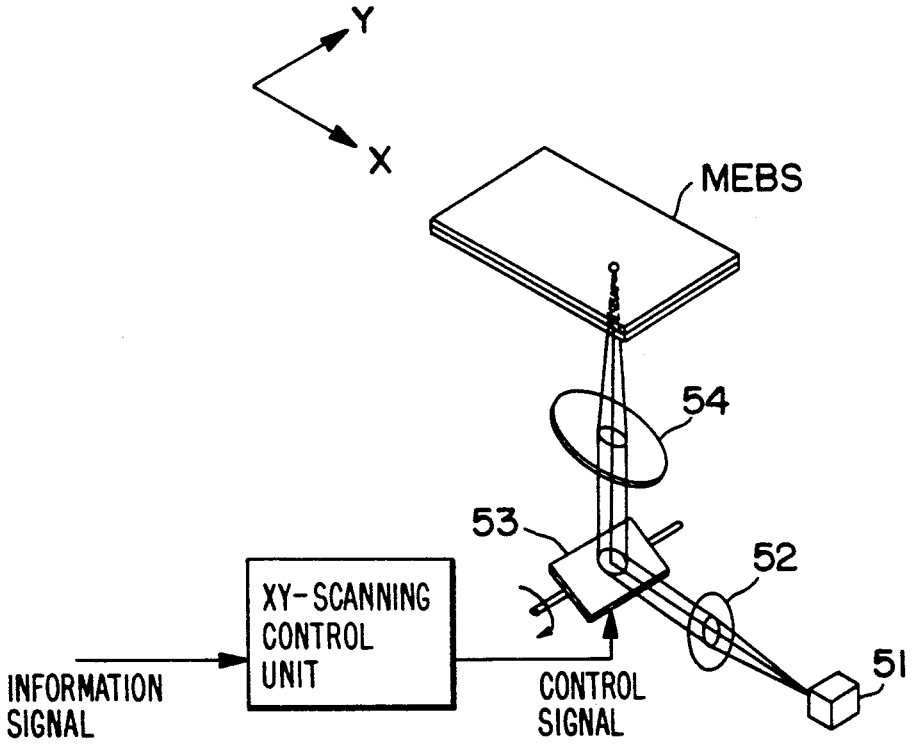
FIG. 8 is a diagrammatical view of a photo beam scanning system.

The MEBS as shown in FIG. 4, in which the electron emitting device as illustrated in FIG. 3 is arranged in an XY matrix fashion, is disposed in a photo beam scanning system as shown in FIG. 8.

In FIG. 8, 51 is a light source, 52, 53, and 54 are each scanning means for scanning a light beam from the light source 51 in X and y directions, 52 is a collimator lens, 53 is a galvanometer mirror and 54 is a focussing lens for scanning in the present invention. Into the scanning means, control signals for XY-scanning of light beams are input.

In the present invention, the light $L_{mn}$ corresponding to an information signal was irradiated from the side of the common first electrode 4 on MEBS using the photo beam scanning system of the constitution shown in FIG. 8, while applying a voltage of 10 V (positive in the common second electrode) between the common first electrode 4 and the common second electrode 5 as shown in FIG. 4. The electron beam $EB_{mn}$ was confirmed to be emitted from the side of the common second electrode 5 on MEBS corresponding to the information signal. The released current density was 100 μA/cm. And it was also confirmed that the electron beam $EB_{mn}$ was not released upon stopping the photo irradiation. In this case, the lesser diode of GaAlAs (beam diameter: 20 μm; 10 mW) is used as the light source, but the other light sources may be used.

The effects of the present invention are as follows:

(1) A device having a simple constitution and capable of emitting an electron beam according to the input of light is provided.

(2) An electron emitting beam conversion device that can use light with a wide range of wavelengths as the input signal is provided.

(3) The constitution of the device can be made simple, and inexpensive electron emitting devices can be provided.

(4) The film thickness can be readily controlled in the molecular order by forming the insulating thin film by the LB process, and also, because of a superior controllability, the device can be formed with a high reproducibility and a rich productivity.

(5) Use of the electron emitting device of the present invention in the electron beam generator can reduce the number of wiring.

We claim:

1. An electron emitting device, comprising a first layer and a second layer laminated thereon, said first layer being capable of undergoing transition from an electrically high resistance state to a low resistance state when irradiated by a radiant ray and said second layer being capable of emitting electrons, and said second layer comprising a pair of electrodes and an insulating layer disposed between said electrodes, said insulating layer comprising a built-up film formed by building up multimonolayers from a monomolecular film of an organic compound.

2. An electron emitting device according to claim 1, wherein said first layer comprises a semiconductor layer.

3. An electron emitting device according to claim 1, wherein said first layer comprises an amorphous silicon layer.

4. An electron emitting device according to claim 1, wherein said first layer comprises a CdS layer.

5. An electron emitting device according to claim 1, further comprising an electron-accelerating electrode, which is disposed on said second layer.

6. An electron emitting device, comprising:

a first electrode disposed on a substrate;

a first layer disposed on said first electrode and capable of undergoing transition from an electrically high resistance state to a low resistance state when irradiated by a radiant ray; and a conductive layer, an insulating layer and a second electrode, sequentially laminated on said first layer;

said first layer being comprised of a laminated structure including a pair of alternating laminated insulating layers and a conductive or semiconductive layer disposed between said alternating laminated insulating layers.

7. An electron emitting device according to claim 6, wherein said first electrode consists of an Au layer, said first layer being laminated on said first electrode and comprises a polyimide layer, an Al layer, and a layer of oxide of Al, and said conductive layer consists of an Al layer.

8. An electron emitting device according to claim 6, further comprising an electron-accelerating electrode, which is disposed on said second electrode.

9. An electron generator, comprising:

an electron emitting device comprising a first layer and a second layer laminated thereon, said first layer being capable of undergoing transition from an electrically high resistance state to a low resistance state when irradiated by a radiant ray and said second layer being capable of emitting electrons;

a means for applying an electric field to said device;

a means for radiating said radiant ray on said device; and said second layer comprising a pair of electrodes and an insulating layer disposed between said electrodes, said insulating layer comprising a built-up film formed by building up multimonolayers from a monomolecular film of an organic compound.

10. An electron emitting device according to claims 1 or 9, wherein said first layer comprises a pnpn-type photodiode.

11. An electron emitting device according to claim 9, further comprising an electron-accelerating electrode, which is disposed on said second layer.

12. An electron generator, comprising:

a first electrode disposed on a substrate;

a first layer disposed on said first electrode and capable of undergoing transition from an electrically high resistance state to a low resistance state when irradiated by a radiant ray;

a conductive layer, an insulating layer and a second electrode, sequentially laminated on said first layer;

a means for applying an electric field to said device;

a means for radiating said radiant ray on said device; and said first layer being comprised of a laminated structure including a pair of alternating laminated insulating layers and a conductive or semiconductive layer disposed between said alternating laminated insulating layers.

13. An electron emitting device according to claim 12, wherein said first electrode consists of an Au layer, said first layer being laminated on said first electrode and comprising a polyamide layer, an Al layer, a layer of an oxide of Al, and said conductive layer consisting of an Al layer.

14. An electron emitting device according to claim 12, further comprising an electron-accelerating electrode, which is disposed on said second electrode.

15. A method for driving an electron emitting device, comprising:

applying a voltage to an electron emitting device comprising a first electrode provided on a substrate, a first layer provided on said electrode and capable of undergoing transition from an electrically high resistance state to a low resistance state when irradiated by a radiant ray, and a conductive layer, an insulating layer and a second electrode, laminated sequentially on said first layer, wherein the voltage is applied between said first electrode and said second electrode;

applying light to said device so that it is incident on one side of said first electrode, whereby an electron beam is emitted from a surface of said second electrode on the side opposite to the light incident side; and said first layer comprises a laminated structure including a pair of alternating laminated insulating layers and a conductive or semiconductive layer disposed between said alternating laminated insulating layers.

16. An electron emitting device according to claim 15, wherein said first electrode consists of an Au layer, said first layer being laminated on said first electrode and comprising a polyamide layer, an Al layer, a layer of an oxide of Al, and said conductive layer consisting of an Al layer.

17. An electron emitting device, comprising a first layer and a plurality of second layers disposed on said first layer, said first layer being capable of undergoing transition from an electrically high resistance state to a low resistance state when irradiated by a radiant ray and each of said plurality of second layers being capable of emitting electrons, each of said plurality of second layers comprising a laminated structure having a conductive layer, an insulating layer, and an electrode, sequentially laminated on said first layer, wherein said insulating layer comprises a built-up film formed by building up multimonolayers from a monomolecular film of an organic compound.

18. An electron emitting device according to claim 17, wherein said electrode is a common electrode with respect to said plurality of second layers.

19. An electron emitting device according to claim 17, wherein said insulating layer comprises a built-up film formed by building up multimonolayers from a monomolecular film of an organic compound.

20. An electron emitting device according to claim 19, wherein said monomolecular film or built-up film has a film thickness of from 5Å to 200Å.

21. An electron emitting device according to claim 17, further comprising an electron-accelerating electrode, which is disposed on said second layers.

22. An electron emitting device comprising:

a first electrode disposed on a substrate;

a first layer disposed on said electrode and capable of undergoing transition from an electrically high resistance state to a low resistance when irradiated by a radiant ray; and a plurality of laminated structures comprising a conductive layer, an insulating layer, and a second electrode, sequentially disposed on said first layer.

23. An electron emitting device according to claim 22, wherein said substrate and said first electrode are transparent or semitransparent to the radiant ray.

24. An electron emitting device according to claim 22, wherein said insulating layer comprises a built-up film formed by building up multimonolayers from a monomolecular film of an organic compound.

25. An electron emitting device according to claim 24, wherein said monomolecular film or built-up film has a film thickness of from 5Å to 200Å.

26. An electron emitting device according to claim 22, wherein said first layer comprises a semiconductor layer.

27. An electron emitting device according to claim 26, wherein said first layer comprises an amorphous layer.

28. An electron emitting device according to claim 26, wherein said first layer comprises a CdS layer.

29. An electron emitting device according to claim 22, wherein said first layer comprises a laminated structure comprising a pair of insulating layers and a conductive or semiconductive layer disposed between said insulating layers.

30. An electron emitting device according to claim 22, wherein said first electrode consists of an Au layer and said first layer is laminated on said first electrode and comprises sequentially a polyimide layer, an Al layer, a layer of oxide of Al, and an Al layer.

31. An electron emitting device according to claim 22, wherein said first electrode consists of an Au layer, said first layer is laminated on said first electrode and comprises sequentially a polyimide layer, an Al layer, and a layer of oxide of Al, and said conductive layer consists of Al.

32. An electron emitting device according to claim 22, further comprising an electron-accelerating electrode, which is so disposed as to interpose said an insulating layer between said second electrode and said electron-accelerating electrode.

33. An electron emitting device according to claim 22, wherein said second electrode is a common electrode with respect to said plurality of laminated structures.

34. An electron generator comprising:

an electron emitting device, comprising a first layer and a plurality of second layers disposed on said first layer, said first layer being capable of undergoing transition from an electrically high resistance state to a low resistance state when irradiated by a radiant ray and each of plurality of second layers being capable of emitting electrons;

a means for applying an electric field to said device;

a means for radiating said radiant ray on said device; and each of said plurality of second layers comprises a laminated structure having a conductive layer, an insulating layer, and an electrode, sequentially laminated on said first layer, wherein said insulating layer comprising a built-up film formed by building up multimonolayers from a monomolecular film of an organic compound.

35. An electron generator comprising:

a first electrode disposed on a substrate;

a first layer disposed on said electrode and capable of undergoing transition from an electrically high resistance state to a low resistance when irradiated by a radiant ray;

a plurality of laminated structures comprising a conductive layer, an insulating layer, and a second electrode, sequentially disposed on said first layer;

a means for applying an electric field to said device; and a means for radiating said radiant ray on said device.

36. An electron emitting device according to claim 35, wherein said means for radiating said radiant ray comprises a radiant ray source and a means for scanning said radiant ray in accordance with an information signal.

37. A method for driving an electron emitting device, comprising:

a first electrode disposed on a substrate;

a first layer disposed on said first electrode and capable of undergoing transition from an electrically high resistance state to a low resistance state when irradiated by a radiant ray;

a plurality of laminated structures comprising a conductive layer, an insulating layer, and a second electrode, sequentially disposed on said first layer said insulating layer comprising a built-up film formed by building up multimonolayers from a monomolecular film of an organic compound; wherein the steps comprise:

applying voltage between said first electrode and said second electrode; and applying light to said device so that it is incident on one side of said first electrode, whereby an electron beam is emitted from a surface of said second electrode on a side opposite to the light incident side.

38. An electron emitting device, comprising:

a first electrode disposed on a substrate;

a first layer disposed on said first electrode and capable of undergoing transition from an electrically high resistance state to a low resistance state when irradiated by a radiant way; and a conductive layer, an insulating layer, and a second electrode, sequentially laminated on said first layer;

said first electrode consisting of an Au layer and said first layer being laminated on said first electrode and comprising sequentially a polyimide layer, an Al layer, a layer of an oxide of Al, and an Al layer.

39. An electron emitting device according to claim 38, further comprising an electron-accelerating electrode, which is disposed on said second electrode.

40. An electron generator, comprising:

a first electrode disposed on a substrate;

a first layer disposed on said first electrode and capable of undergoing transition from an electrically high resistance state to a low resistance state when irradiated by a radiant ray; and a conductive layer, an insulating layer, and a second electrode, sequentially laminated on said first layer;

a means for applying an electric field to said device;

a means for radiating said radiant ray on said device, and said first electrode consisting of an Au layer and said first layer being laminated on said first electrode and comprising sequentially a polyimide layer, and Al layer, a layer of an oxide of Al, and an Al layer.

41. A method for driving an electron emitting device, comprising:

applying a voltage to an electron emitting device comprising a first electrode provided on a substrate, a first layer provided on said electrode and capable of undergoing transition from an electrically high resistance state to a low resistance state when irradiated by a radiant ray, and a conductive layer, an insulating layer and a second electrode, laminated sequentially on said first layer, wherein the voltage is applied between said first electrode and said second electrode; and applying light to said device so that it is incident on one side of said first electrode, wherein an electron beam is emitted from a surface of said second electrode on the side opposite to the light-incident side; and said first electrode consisting of an Au layer and said first layer being laminated on said first electrode and comprising sequentially a polyimide layer, an Al layer, a layer of an oxide of Al, and an Al layer.

* * * * *

UNITED STATES PATENT AND TRADEMARK OFFICE

CERTIFICATE OF CORRECTION

PATENT NO. : 5,136,212

DATED : August 4, 1992

INVENTOR(S) : KEN EGUCHI ET AL.

It is certified that error appears in the above-identified patent and that said Letters Patent is hereby corrected as shown below:

COLUMN 1

Line 66, "avalenches" should read --avalanches--.

COLUMN 2

Line 20, "comprising;" should read --comprising:--.
Line 35, "apoplying" should read --applying--.
Line 40, "comprising;" should read --comprising:--.
Line 56, "of;" should read --of:--.

COLUMN 4

Line 33, "(i,e," should read --(i.e.,--.
Line 64, "squalilium" should read --squarilium--.

COLUMN 8

Line 31, "$1X10^3M$" should read --$1X10^{-3}$ M--.

COLUMN 9

Line 33, "a" should read --an--.

UNITED STATES PATENT AND TRADEMARK OFFICE

CERTIFICATE OF CORRECTION

PATENT NO. : 5,136,212

DATED : August 4, 1992

INVENTOR(S) : KEN EGUCHI ET AL.

It is certified that error appears in the above-identified patent and that said Letters Patent is hereby corrected as shown below:

COLUMN 17

Line 49, "an" should be deleted.

Signed and Sealed this

Seventh Day of September, 1993

Bruce Lehman

*Attest:*

BRUCE LEHMAN

*Attesting Officer*

*Commissioner of Patents and Trademarks*